US005165360A

United States Patent [19]

Moody

[11] Patent Number: 5,165,360

[45] Date of Patent: Nov. 24, 1992

[54] UNDERWATER RAPID-FIRE RAM PUMP

[75] Inventor: Paul E. Moody, Barrington, R.I.

[73] Assignee: The United States of America as represented by the Secretary of the Navy, Washington, D.C.

[21] Appl. No.: 667,795

[22] Filed: Mar. 11, 1991

[51] Int. Cl.[5] ..... B63G 8/28

[52] U.S. Cl. ..... 114/319; 114/316

[58] Field of Search ..... 114/318, 319, 238, 316, 114/239, 317; 89/1.809, 1.81

[56] References Cited

U.S. PATENT DOCUMENTS 2,848,970 8/1958 Gunning ..... 114/319

*Primary Examiner*—Edwin L. Swinehart

*Attorney, Agent, or Firm*—Michael J. McGowan; Prithvi C. Lall; Michael F. Oglo

[57] ABSTRACT

An apparatus is provided that is capable of a rapid firing sequence for an underwater dual barrel launcher. An air cylinder assembly drives a water piston housed in a water cylinder in either of two opposing piston stroke directions. The water cylinder is continually supplied and balanced with sea pressure. A piston stroke in a first direction pressurizes impulse water in the water cylinder that is then supplied to a first launch tube of the dual barrel launcher. A piston stroke in an opposing second direction again pressurizes impulse water in the water cylinder that is then supplied to a second launch tube. Thus, each opposing piston stroke is a power stroke.

9 Claims, 3 Drawing Sheets

UNDERWATER RAPID-FIRE RAM PUMP

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

This invention relates generally to underwater launching systems and more particularly to an underwater launching system that uses a ram pump to achieve rapid-fire launching.

(2) Description of the Prior Art

Submarine small device launchers are typically dual barrel devices. Traditionally, launching has been accomplished through the use of a ram pump device which varies impulse air pressure in order to overcome sea pressure at varying depths. The main problems associated with this type of launcher are: 1) Unreliability of the pressurization system as the depth of the submarine varies, 2) the noise signature associated with firing the launcher, and 3) the time required for the return to battery stroke.

Another prior art launcher makes use of a turbine pump for launching large devices such as 21 inch diameter by 21 foot long torpedoes. Since this device has no return to battery stroke, it is faster than the ram pump. For the same reason, the turbine pump has a quieter noise signature than the ram pump. However, it is much more expensive to develop and build and is not practical for the ejection of small devices (3–6 inch diameter by up to 39½ inch long devices) due to the extremely high acceleration requirements for such a launch.

SUMMARY OF THE INVENTION

Accordingly, it is an object of the present invention to provide a dual barrel underwater launcher that can achieve a rapid firing sequence.

It is a further object of the present invention to provide a dual barrel underwater launcher that is pressure balanced with submergence pressure.

Still another object of the present invention is to provide a dual barrel underwater launcher that minimizes the noise signature associated with a launch.

Yet another object of the present invention is to provide a dual barrel underwater launcher that is of economical design.

Other objects and advantages of the present invention will become more obvious hereinafter in the specification and drawings.

In accordance with the present invention, an apparatus is provided for the rapid-fire underwater launching of projectiles from a dual barrel launcher having two launch tubes. A water cylinder is functionally connected to the two launch tubes. The water cylinder is always filled with seawater at sea pressure. A water piston, slidably engaged within the water cylinder, is alternately moved in opposing first and second piston stroke directions. The water ahead of the piston during the first and second piston stroke is pressurized by the respective piston stroke. The pressurized water is supplied to the first launch tube during the first piston stroke, thereby providing projectile launch strokes during both the first piston stroke and the opposing direction second piston stroke. Herein the reference to piston stroke will refer to a power stroke providing for the ejection of a projectile. and the second launch tube during the second piston stroke. Means are also provided for back flooding the water cylinder with seawater behind the first and second piston strokes alternately. In this way, the water cylinder is always filled with water at submergence pressure in preparation for the next launch.

DESCRIPTION OF THE PREFERRED EMBODIMENTS

Figure 1:
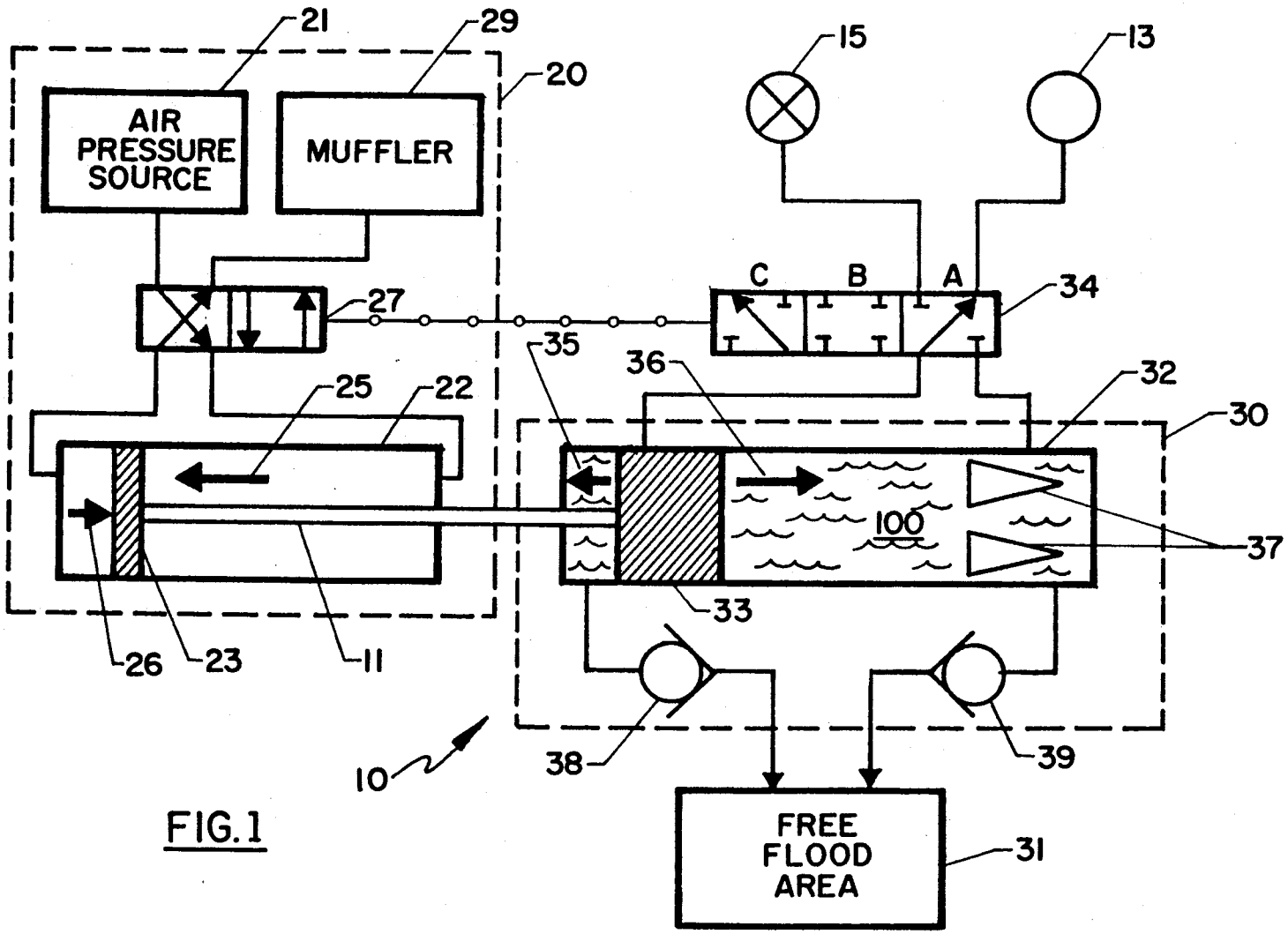
FIG. 1 is a schematic view of the underwater rapid fire ram pump according to the present invention.

Referring now to the drawings and in particular to FIG. 1, a schematic view is shown of the underwater rapid-fire ram pump according to the present invention referenced generally by numeral 10. Ram pump 10 consists of an air cylinder system 20 functionally connected to a water cylinder system 30 via a connecting piston rod 11. When air from air pressure source 21 is injected into air cylinder 22, it pushes air piston 23 in the direction shown by arrow 25. At the same time, firing valve 27 vents the other end of air cylinder 22 through a muffler 29. The movement of air piston 23 connected to piston rod 11 will in turn move water piston 33 in water cylinder 32 in a piston stroke direction indicated by arrow 35.

Water cylinder 32 is always kept filled with seawater 100 at sea pressure, as will be explained further hereinbelow. The movement of water piston 33 in the direction of arrow 35 pressurizes the seawater 100 ahead of water piston 33 and draws in seawater behind piston 33. The terms "ahead" and "behind" are used with respect to the piston stroke direction 35 or 36. It is this pressurized water that will be used as impulse water to launch a projectile from a first launch tube 13 of two launch tubes 13 and 15. Launch tubes 13 and 15 form a conventional dual barrel launching device. Launch tube 13 is shown in a launch mode while launch tube 15 is shown in a non-launch mode as is indicated by the cross through tube 15.

The pressurized water may be supplied to launch tube 13 in a variety of ways. For the embodiment shown, a three-position valve 34 is used. In position "A", pressurized seawater ahead of water piston 33 is supplied to launch tube 13. Alternately, when air from air pressure source 21 pushes air piston 23 in the direction shown by arrow 26, water piston 33 moves in a piston stroke direction indicated by arrow 36. Impulse water is then supplied for the launching of a projectile from launch tube 15 as valve 34 switches to position "C". At the same time, seawater will be drawn in behind water piston 33 to again fill water cylinder 32. Firing valve 27 is interlocked with valve 34 so that when air pushes air piston 23 in the direction shown by arrow 25, valve 34 is in position "A" when air pushes air piston 23 in the direction shown by arrow 26, valve 34, is in position "C".

As is readily apparent, water piston 33 is a ram pump that does not require a return to battery stroke. Each opposing piston stroke, indicated by arrows 35 and 36, is a power stroke used to provide impulse water to one of two launch tubes 13 or 15, respectively. Accordingly, a rapid firing sequence can be attained using the inexpensive ram pump design. The firing air supplied by air pressure source 21 maintains air piston 23 at battery after launching.

In order to reduce the noise signature associated with each opposing piston power stroke, peripheral dashpots 37 (the depicted triangular ports creating the dashpot function by interaction with the water piston, as is conventional practice in the art)--are provided about the periphery of both end of water cylinder 32. Dashpots 37 (hidden by piston 33 in one end of cylinder 32) insure a uniform deceleration of water piston 33 when approaching the end of its piston stroke in either stroke direction 35 or 36. For sake of simplicity, dashpots 37 are shown on only one end of water cylinder 32. Also provided are check valves 38 and 39 at either end of water cylinder 32 to: 1) allow water piston 33 to draw water from a free flood area 31 to back flood water cylinder 32 behind water piston 33 and 2) block the flow of water back to free flood area 31 from the pressurized side of water piston 33 ahead of the respective piston stroke. Free flood area 31 might be the sea or a tank (not shown) within the ship's outer hull which is always flooded.

Figure 2:
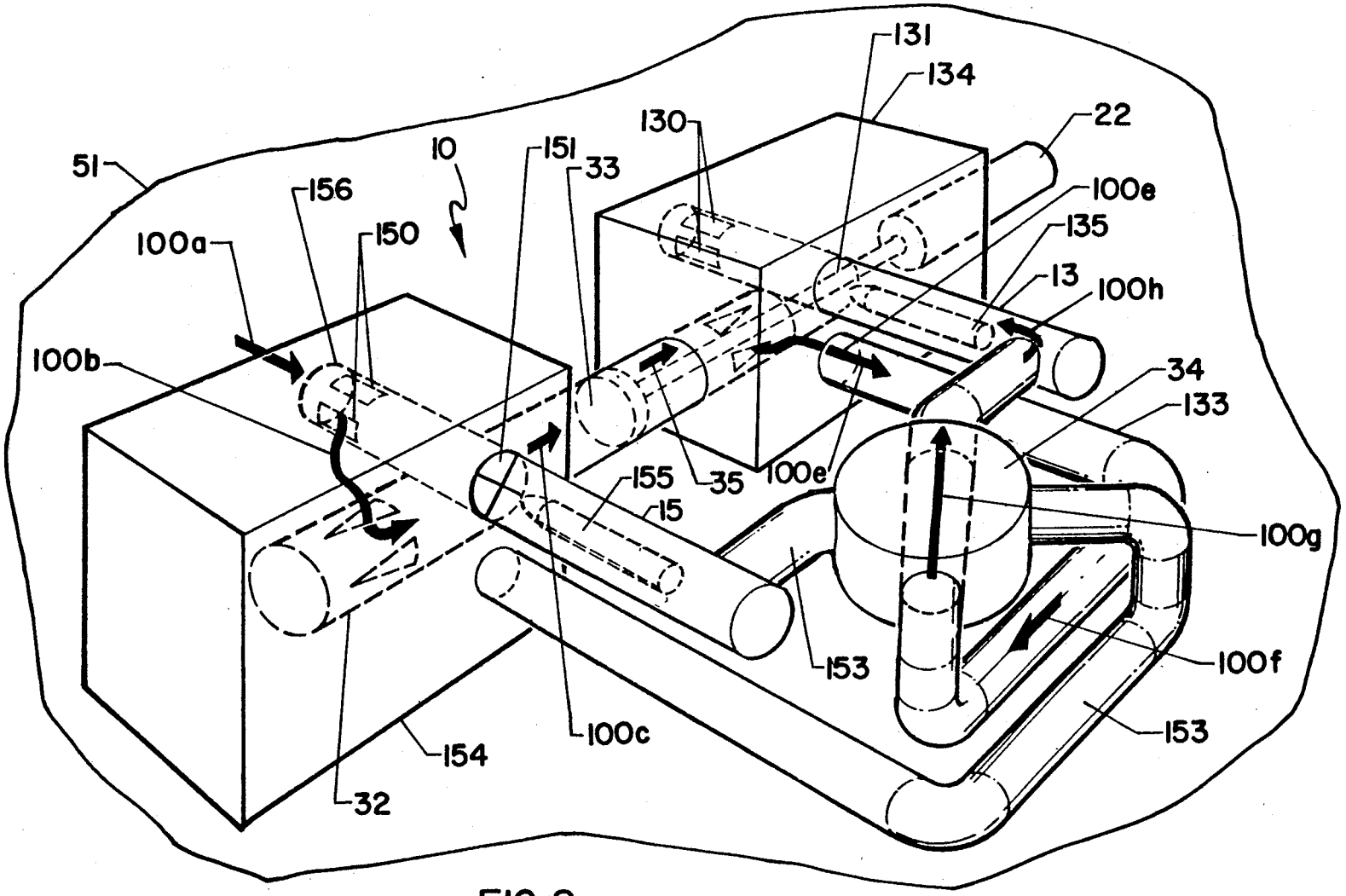
FIG. 2 is a perspective view of the rapid fire ram pump undergoing a first piston stroke to fire the first launch tube.
Figure 3:
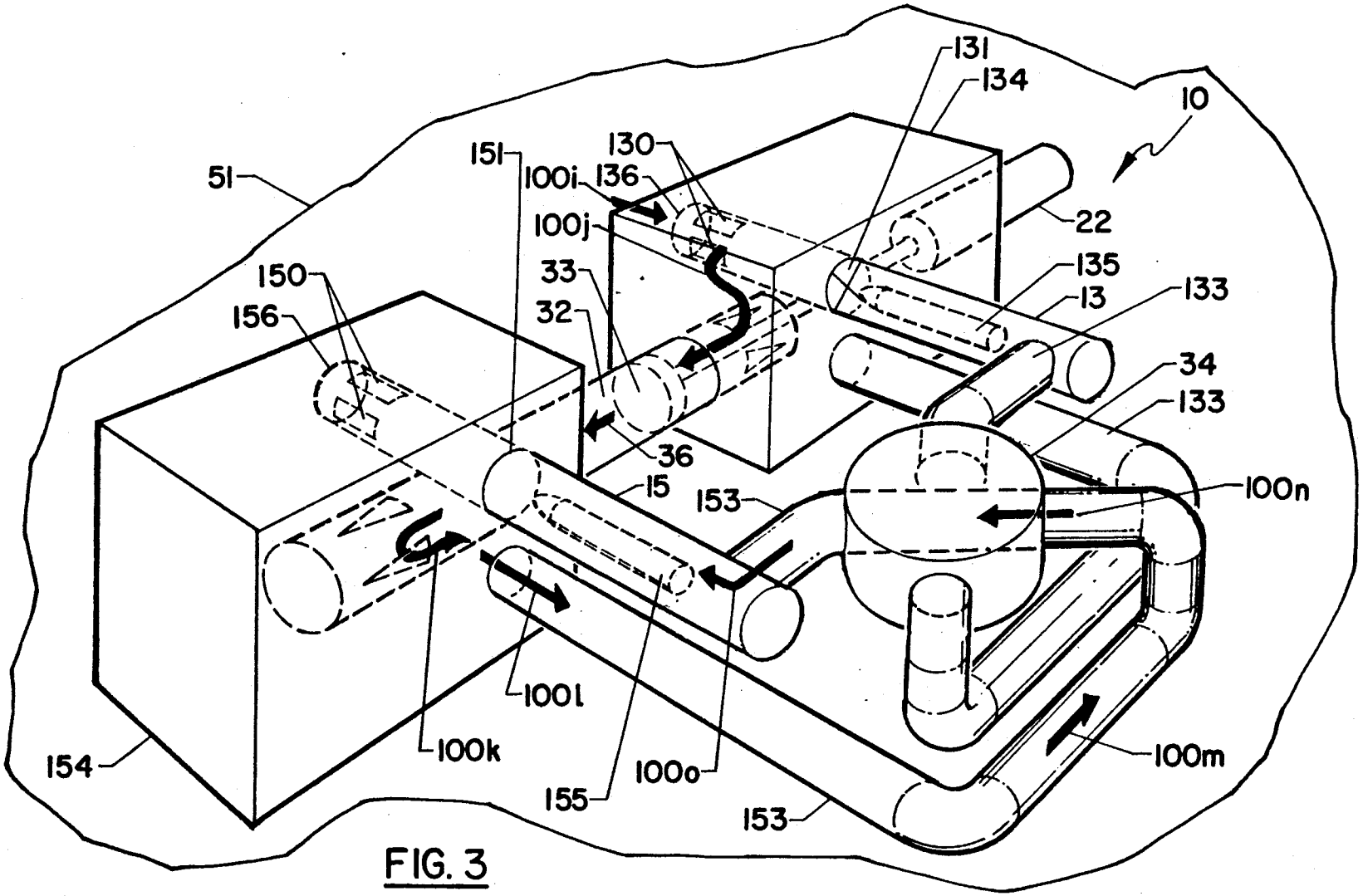
FIG. 3 is a perspective view of the rapid fire ram pump undergoing an opposing piston stroke to that shown in FIG. 2 to fire the second launch tube.

Further description of the present invention will now make reference to FIGS. 2 and 3 in order to better understand the water flow within rapid fire ram pump 10. Common elements will share common reference numerals with FIG. 1. FIG. 2 is a perspective view of ram pump 10 showing the movement of water piston 33 and associated water flow that provides impulse water to launch tube 13. FIG. 3 is a perspective view of ram pump 10 showing the movement of water piston 33 and associated water flow that provides impulse water to launch tube 15. The components in FIGS. 2 and 3 are shown in an expanded relation to one another for clarity. However, in practice, the components will occupy a more compact relationship. The compact relationship is achieved by utilizing a water piston 33 that has a larger diameter than the diameter of the launch tubes 13 and 15.

Referring now to FIG. 2, ram pump 10 is shown mounted in a hull 51 of an underwater vehicle. Hull 51 is shown only in section. A plurality of slide valve ports 150 are provided in launch tube 15 forward of muzzle door 151. Slide valve ports 150 are thus constantly exposed to seawater and, when open, are arranged to port water to water cylinder 32. For the embodiment shown, water passing through slide valve ports 150 is ported to water cylinder 32 via seawater tank 154. A major advantage of using slide valve ports is that they require no seals while minimizing inlet flow velocity. However, it is to be understood that water may be ported to water cylinder 32 in a variety of ways. Indeed, the slide valve ports 150 and muzzle door 151 may be replaced by a three-port muzzle door ball valve, although at the expense of a greater inlet flow velocity. A flow through position of such a three-port valve would permit firing while a choke flow position would port the seawater to the water tank 154.

As water piston 33 moves in a piston stroke direction 35, slide valve ports 150 are opened allowing seawater to enter water cylinder 32 behind water piston 33. The flow of seawater into water cylinder 32 is shown progressively by arrows 100*a*, 100*b* and 100*c*. This flow path permits water to replace the volume vacated by the water piston 33 as it is moving in piston stroke direction 35. During piston stroke direction 35, water transfer tube 153 is closed off from launch tube 15 by the positioning of the four-port, three-position ball valve 34. In addition, slide valve ports 150 are functionally connected with muzzle door 151 so that when slide valve ports 150 are open, muzzle door 151 is closed as indicated by the cross.

At the same time, the pressurized water flow ahead of piston 33 in piston stroke direction 35 is indicated by arrows 100*e*, 100*f*, 100*g* and 100*h*. Water flow follows arrows 100*e*-100*h* as it moves from water cylinder 32 through water transfer tube 133 and into launch tube 13. The slide valve ports 130 in launch tube 13 are functionally connected to muzzle door 131 so that when muzzle door 131 is open as shown, slide valve ports 130 are closed. In this way, piston stroke direction 35 effects the launching of projectile 135 without loss of impulse water via slide valve ports 130.

In FIG. 3, the opposing piston stroke direction 36 pressurizes the water in water cylinder 32 to launch a projectile 155 through launch tube 15. As water piston 33 moves in piston stroke direction 36, slide valve ports 150 are closed and muzzle door 151 is opened. Ball valve 34 is repositioned to open water transfer tube 153 to launch tube 15. The water pressurized by the movement of water piston 33 is forced through water transfer tube 153 and is used to propel projectile 155 out of launch tube 15. This water flow is shown progressively by arrows 100*k*, 100*l*, 100*m*, 100*n* and 100*o*.

At the same time, piston stroke 36 effects an opposite sequence of events at launch tube 13. In particular, 1) slide valve ports 130 are opened to flood seawater tank 134 and thereby back flood water cylinder 32 behind water piston 33, 2) ball valve 34 is positioned to close off water transfer tube 133 to launch tube 13, and 3) seawater flows into water cylinder 32 behind piston 33 as shown progressively by arrows 100*i* and 100*j*.

The dimensions of the various elements in rapid fire ram pump 10 will vary depending upon application. However, to insure that projectile 135 and 155 are properly launched, the displacement of each piston stroke must be greater than or equal to the combined displacement of the launch tube and water transfer tube extending from and forward of the launch tube's muzzle door. In order to maximize the stability of water piston 33 during each piston stroke, a length to diameter ratio of approximately 1:1 is recommended for water piston 33.

The water inlet used to fill water cylinder 32 behind piston strokes 35 and 36, respectively, is provided by the respective exit holes 156 and 136 of launch tubes 13 and 15. Thus, only two hull openings are required for the entire system. These exit holes pass through the hull 51 of an underwater vehicle. The short flow path of the water during the back flood process minimizes pipe losses and choked flow, which are so often problems in underwater launch systems. Furthermore, if the exit holes are small (6 inch, diameter for a small device launcher), a hull flow field traveling over an open exit hole causes a minimal portion of the vehicle's noise signature. Thus, the system will have minimum flow losses when firing.

The advantages of the present invention are numerous. By utilizing both piston stroke directions as power strokes, the dual barrel launcher can achieve a rapid firing sequence. The system is easily pressure balanced with sea pressure and has a reduced noise signature. Furthermore, a ram pump is an economical design. A ram pump design of the present invention also permits the majority of the system weight to be located close to the hull of the underwater vehicle thereby reducing shock stress on the hull in comparison to earlier cantilever designs. This benefit is achieved by the linear orientation of air and water cylinders 22 and 32, respectively, and seawater tanks 154 and 134 and their close proximity to the exit holes 156 and 136. By supporting all of this weight at the hull, stresses transferred to the hull are minimized under shock load conditions, such as underwater explosions.

Of course, while the present invention has been described specifically to facilitate an understanding of its operation, it is not so limited. An alternative embodiment could be readily achieved by replacing the four-port, three-position valve 34 with two two-position valves. Another alternative would be to replace seawater tanks 154 and 134 with a single seawater tank having a baffle to support the back flooding of water cylinder 32 in both piston directions. Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An apparatus for rapid fire underwater launching of projectiles from a launcher having two launch tubes each having a muzzle door comprising:

a water cylinder functionally connected to the two launch tubes, said water cylinder being filled with seawater at sea pressure;

a water piston slidably engaged within said water cylinder;

means, connected to said water piston, for alternately moving said water piston in first and second opposing piston strokes in response to a request for launch, whereby the seawater within said water cylinder and ahead of said water piston during said first and second piston stroke, alternately, is pressurized;

means for supplying said pressurized water to: a first of the launch tubes during said first piston stroke and a second of the launch tubes during said second piston stroke; and means for connecting said water cylinder to seawater behind said first and second piston stroke, alternately, whereby the available volume on both ends of said water cylinder is always filled with seawater.

2. An apparatus as in claim 1 further comprising means for alternately effectively uniform deceleration of said water piston at the end of said first and said second piston strokes.

3. An apparatus as in claim 2 wherein said uniform deceleration means comprises a plurality of peripheral dashpots formed by tapered slotted ports that a low the stroke of the water piston to cause a continuous and smooth closing action of the port, said slotted ports located around each end of said water cylinder.

4. An apparatus as in claim 1 wherein said alternately moving means comprises:

a piston rod fixably connected to said water piston; and an air cylinder system functionally connected to said piston rod for driving said piston rod alternately in said first and said second piston stroke directions in response to the request for launch, said system including an air pressure source for causing said first and second piston strokes.

5. An apparatus as in claim 1, each of the launch tubes having a muzzle door wherein slide valve ports are exposed to seawater and located forward of the tube's muzzle door for connecting said water cylinder to seawater when the muzzle door is closed and for preventing seawater from entering said water cylinder when the muzzle door is open.

6. An apparatus as in claim 1, said water cylinder having a displacement greater than or equal to a combined displacement of one launch tube and its respective transfer tube extending from the launch tube muzzle door to an outer hull of an underwater vehicle.

7. An apparatus as in claim 1, wherein said means for supplying comprises:

a first water transfer tube connecting said water cylinder to said first launch tube, wherein said first water transfer tube is open during said first piston stroke and closed during said second piston stroke;

a second water transfer tube connecting said water cylinder to said second launch tube, wherein said second water transfer tube is open during said second piston stroke and closed during said first piston stroke; and means functionally connected to said first and second water transfer tubes for effecting said opening and closing.

8. An apparatus as in claim 7 wherein said opening and closing effecting means comprises a four-port, three-position ball valve.

9. An apparatus as in claim 7 wherein said opening and closing effecting means comprises two two-position valves.

* * * * *